United States Patent [19]
Scherrer et al.
[11] 4,222,853
[45] Sep. 16, 1980

[54] APPLICATION OF SULFOSUCCINIC ESTER ANTI-FOULING AGENTS

[75] Inventors: Claude Scherrer; Marc Durrieu, both of Le Havre, France; John R. Richmond, High Beach, England

[73] Assignees: Compagnie Francaise de Raffinage; Universal Matthey Products France, both of Paris, France

[21] Appl. No.: 25,450

[22] Filed: Mar. 28, 1979

[30] Foreign Application Priority Data

Apr. 4, 1978 [FR] France ..... 78 09855

[51] Int. Cl.[2] ..... C10G 9/16; C09K 15/12; C23F 14/02

[52] U.S. Cl. ..... 208/48 AA; 208/348; 252/395; 585/950

[58] Field of Search ..... 208/48 AA, 348, 251 R, 208/187–188; 203/7, 8; 252/8.3, 389 R, 400 R, 395, 406; 585/950

[56] References Cited

U.S. PATENT DOCUMENTS

| | | | |
|---|---|---|---|
| 2,548,630 | 4/1951 | Sorg et al. | 252/395 X |
| 2,579,890 | 12/1951 | Wies et al. | 44/70 |
| 2,948,596 | 8/1960 | Ambrose et al. | 44/58 |
| 3,105,810 | 10/1963 | Miller et al. | 208/48 AA |
| 3,116,128 | 12/1963 | Fareri et al. | 44/71 |
| 3,776,835 | 12/1973 | Dvoracek | 208/48 AA |
| 3,920,572 | 11/1975 | King et al. | 252/75 |
| 4,107,030 | 8/1978 | Slovinsky et al. | 208/48 AA |

FOREIGN PATENT DOCUMENTS

| | | | |
|---|---|---|---|
| 1488184 | 7/1967 | France | 44/71 |

*Primary Examiner*—Delbert E. Gantz
*Assistant Examiner*—G. E. Schmitkons
*Attorney, Agent, or Firm*—Haseltine, Lake & Waters

[57] ABSTRACT

The invention relates to anti-fouling agents capable of decreasing the fouling of equipment in contact with a hydrocarbon charge.

These agents comprise at least one compound selected from the group consisting of substances having the formula:

where R and R′ are linear or branched alkyl radicals having between 4 and 12 carbon atoms and where M is a metal atom of Groups IA and IIA of the Periodic Table, with n=1, when the metal M is a metal of Group 1A, and
n=2, when the metal M is a metal of Group IIA.

An example of such an agent is sodium di-2-ethylhexyl-sulfosuccinate.

5 Claims, 3 Drawing Figures

APPLICATION OF SULFOSUCCINIC ESTER ANTI-FOULING AGENTS

The invention concerns new anti-fouling agents and the application of said agents to the treatment of crude petroleum.

A current problem in the petroleum refining industry is that posed by the fouling of equipment, such as for example, heat exchangers, into which charges from different units of a refinery pass. In fact, deposits attributed to the presence of organic or inorganic materials in the charges form on the interior at these heat exchangers.

The mechanism of this fouling is complex and varied; this fouling can be provoked by accumulations of oxidation products, asphaltene deposits, salts or by scaling phenomena. For example, in the case of the hottest exchangers in a preheating chain for crude petroleum preceding a distillation under atmospheric pressure, the deposits are constituted by 50 to 70% by weight of mineral compounds, notably compounds of iron (oxides, sulfides) and by 50 to 30% of organic compounds (asphaltenes, carbenes). It may also be due to organic compounds which polymerize under the action of heat, oxides or oxygen dissolved in the crude petroleum.

Thus, the fouling of these exchangers involves, besides very frequent cleaning operations, an increase in the consumption of energy necessary to heat the charge, due to the loss in efficiency of the exchangers. The use of anti-fouling agents is an economic means to combat this fouling. The anti-fouling agent is a chemical product which is added to the charge in very low concentrations, in the order of several parts per million by volume. Numerous types of anti-fouling agents have already been employed, such as, for example, agents based on phosphoric esters.

The inventors have discovered that chemical compounds known under the name of sulfosuccinates, have a very interesting anti-fouling action. The inventors had already established that products of this type have a de-emulsifying action on stable emulsions which form in the desalting units for crude petroleum, this invention having been made the object, in France, of patent application No. 77 11 906, filed Apr. 20, 1977. But, although the usual de-emulsifying agents are not used as anti-fouling agents, the inventors have discovered that sulfosuccinates also have an anti-fouling action.

The aim of the present invention is therefore to provide novel anti-fouling agents.

Consequently the present invention has, as its primary object, novel anti-fouling agents capable of at least diminishing the fouling of equipment in contact with a charge of crude petroleum, said agents being characterized in that they are constituted, in part or in whole, by at least one compound selected from the group consisting of those having the formula:

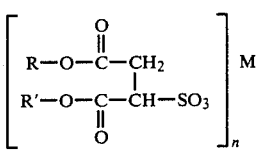

where R and R′ are linear or branched alkyl radicals having between 4 and 12 carbon atoms and where M is an atom of a metal of Groups IA and IIA of the Periodic Table, with:

n=1, when the metal M is a metal of Group IA, and n=2, when the metal M is a metal of Group IIA. A second object of the invention is the application of the anti-fouling agents represented by the above formula to the treatment of crude petroleum.

The inventors have thus used with success sodium di-2-ethylhexylsulfosuccinate as an anti-fouling agent for crude petroleum.

The anti-fouling agents according to the invention can be particularly used for the treatment of crude petroleum subject to distillation under atmospheric pressure.

Prior to distillation under atmospheric pressure, the crude petroleum, preheated in a first series of exchangers is submitted to a desalting operation in a desalting unit, then preheated in a second series of exchangers, before introduction into the oven preceding the distillation tower.

The anit-fouling agent can, for example, be introduced into the crude petroleum after it leaves the desalting unit and before it enters the second series of preheating exchangers.

The anti-fouling agent can also be introduced into the crude petroleum directly in the desalting unit, as the de-emulsifying agent capable of breaking the stable emulsions which can form therein, as described in the French patent application No. 77 11 906 previously cited. The agent has therefore, in this case, both a de-emulsifying action on the stable emulsion and an anti-fouling action.

The agent is injected into the desalting unit, at the level where the stable emulsion is apt to form, by using a suitable introducing system. This injection can be made in a discontinuous manner, when the stable emulsion is detected, and/or in a continuous manner in order to avoid the formation of a stable emulsion and/or to avoid the deposit of the stable emulsion on the introducing system. The anti-fouling and de-emulsifying agent, thus introduced into the crude phase contained in the desalted material, is entrained thereby in the second series of exchangers and by its presence contributes to avoiding the fouling of said exchangers.

The anti-fouling agents can be introduced into the crude petroleum in solution in hydrocarbons.

The anit-fouling agents are used in an amount such that the crude petroleum passing through the exchangers contains preferably a maximum of 100 ppm by volume of the anti-fouling agent with respect to the volume of the crude petroleum. This higher limit of 100 ppm is only justified by the cost of the anit-fouling agent.

The Examples which follow are intended to illustrate the invention but not in a limiting manner. The Examples refer to the drawings in which.

EXAMPLE 1

This example is intended to illustrate the lowering of the fouling of an exchanger for a crude petroleum when there is introduced into this crude petroleum at the exit of the desalting unit, an anti-fouling agent according to the invention.

In this example the fouling of a pilot exchanger was determined in three tests:

Control test TA1 is a comparative test carried out with a desalted crude Iraqi petroleum KIRKOUK not containing any anti-fouling agent, Control test, TA2 is a comparative test carried out with the same crude petroleum containing 80 ppm by volume of a commercial anti-fouling agent bases on a phosphoric ester, containing 50% of active material, Test A is a test carried out with the same crude petroleum containing an anti-fouling agent according to the invention, in the amount of 80 ppm by volume, comprising a solution of 50% of sodium di-2-ethylhexyl-sulfosuccinate in a heavy aromatic solvent.

Tests TA2 and A were thus carried out with the addition to the crude petroleum of the same quantity of active material of the anti-fouling agent.

Figure 1:
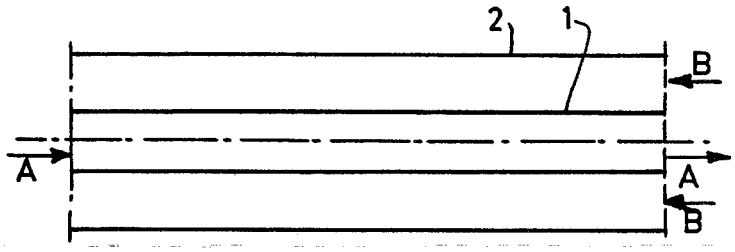
FIG. 1 is a schematic section of a pilot exchanger in which the Examples were carried out.

Tests TA1, TA2 and A were carried out in a pilot exchanger such as represented in FIG. 1. This exchanger consists of a tube 1, placed coaxially in a tube 2.

Tube 1 is a tube having an exterior diameter of 1.372 cm and an interior diameter of 0.925 cm ("schedule" No. 40: see WUITHIER *Raffinage et Genie Chimique,* Vol. II, page 1051).

Tube 2 is a tube having an exterior diameter of 2.667 cm and an interior diameter of 2.093 cm ("schedule" No. 40).

The length of tubes 1 and 2 is 2 meters.

The crude petroleum circulates in tube 1, in the direction indicated by arrow A. A heat transfer fluid circulates in tube 2 in the direction indicated by arrow B. Therefore a simple counter-current exchange is involved.

The flow rates of the crude petroleum and of the heat transfer fluid were kept constant at a value of 5 1/hr.

The inlet temperature of the crude petroleum in tube 1 was maintained constant at 140° C.

The inlet temperature of the heat transfer fluid in tube 2 was maintained constant at 310° C.

The exit temperatures of the crude petroleum in tube 1 and of the heat-transfer fluid in tube 2 vary as a function of the degree of fouling and, from these temperatures, the transfer coefficient of the exchanger can be calculated (see for example WUITHIER, *Raffinage et Genie Chimique,* Vol. II—page 1059 ff)

The equation:

$$Rs=(1/U_s)-(1/U_p)$$

where $R_s$ is the resistance of the foulant, $U_s$ the transfer coefficient of the fouled tube, $U_p$ the transfer coefficient of the clean tube, permits following the fouling of the exchanger as a function of time.

Figure 2:
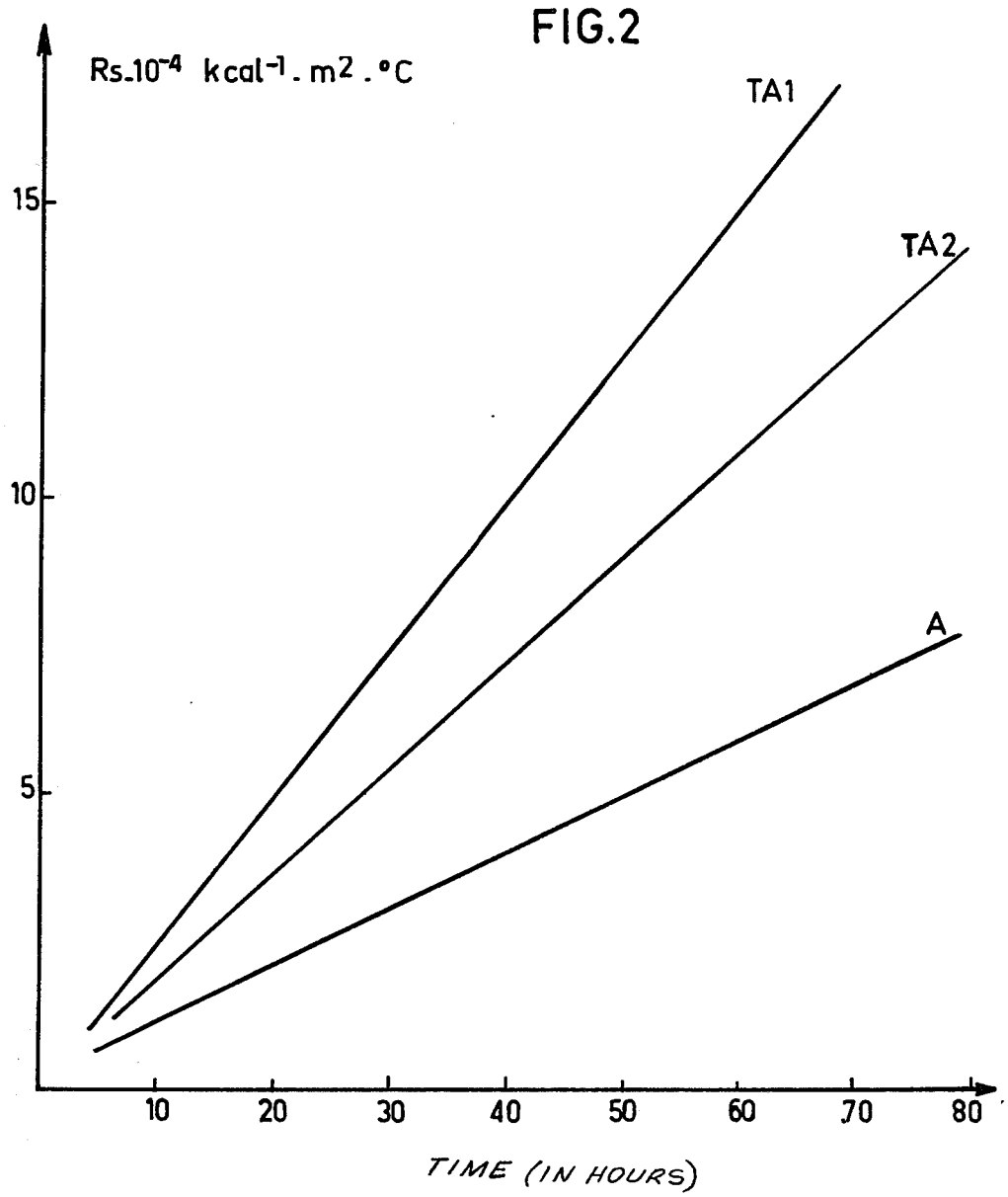
FIGS. 2 and 3 illustrate the variation in the resistance of the deposits as a function of time calculated from the results of these tests.

In FIG. 2 there are shown the straight lines obtained with the results of Tests TA1, TA2 and A. The slopes of these straight lines show the speed of fouling.

They are respectively (in $Kcal^{-1}.m^2.°C.h^{-1}$):

for TA1: $2.5\cdot10^{-1}$):
for TA2: $1.9\cdot10^{-5}$,
for A: $1.05\cdot10^{-5}$.

The velocity of fouling is thus reduced by 58%, if there is added to the crude petroleum an anti-fouling agent according to the invention whereas it is only reduced by 24% by adding a conventional anti-fouling agent. The use of an anti-fouling agent according to the invention permits practically doubling the interval between two cleanings of the exchanger.

EXAMPLE 2

This example is intended to illustrate the lowering of the fouling of an exchanger for crude petroleum when there is introduced into the desalting unit, to eliminate the stable emulsion which forms therein, an anti-fouling agent according to the invention.

Two tests were carried out with the same pilot exchanger and the same conditions as those used in Example 1.

Control test TB was carried out with a crude desalted petroleum from a field in Saudi Arabia (light Arabian). This petroleum contains 6% by weight of a stable emulsion, this emulsion containing itself:

70% by weight of water,
28.5% by weight of crude petroleum,
1.5% by weight of insoluble products.

Test B was carried out with the same desalted crude petroleum but not containing a stable emulsion, this havingbeen destroyed in the desalting unit by continuous injection at the water-crude interface of 20 ppm by volume with respect to the crude petroleum of an anti-fouling agent according to the invention, consisting of a solution of 50% sodium di-2-ethylhexylsulfosuccinate in a heavy aromatic solvent.

Figure 3:
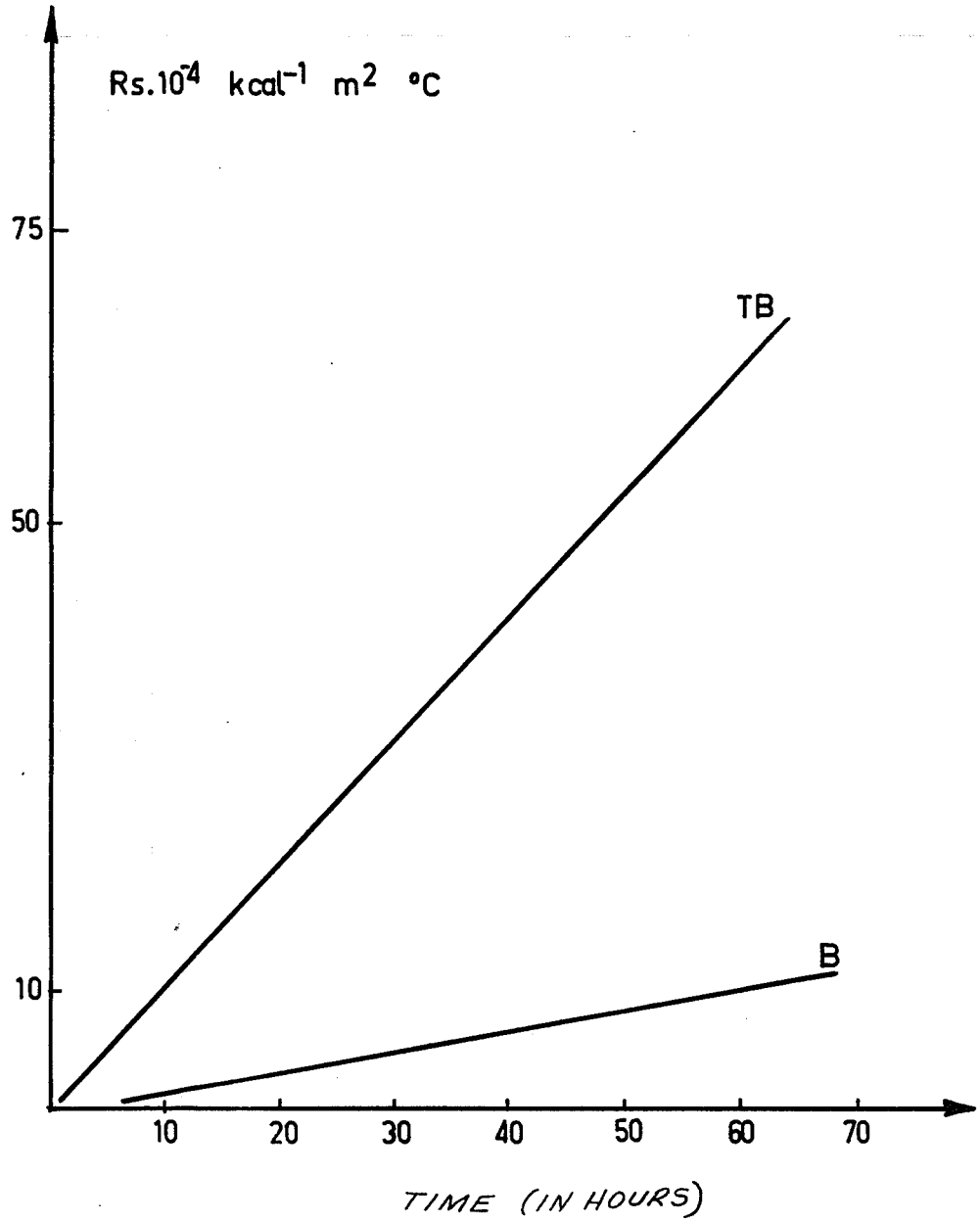

In FIG. 3 are shown the straight lines obtained with the results of tests TB and B.

The slopes of these straight lines give the fouling velocities. They are respectively (in $Kcal^{-1}\cdot m^{-2}.°C.h^{-1}$):

for TB: $11\cdot10^{-5}$
for B: $3\cdot10^{-5}$

The speed of fouling is thus reduced by 73% if there is added to the crude petroleum in the desalting unit in order to destroy the stable emulsion, an anti-fouling agent according to the invention.

Examples 1 and 2 thus show the efficacy of an anti-fouling agent according to the invention to combat the fouling of exchangers when this agent is injected into the desalting unit or after the desalting unit.

We claim:

1. A method of decreasing the fouling of equipment in contact with crude petroleum comprising the step of adding to the crude petroleum an anti-fouling amount of at least one compound having the formula:

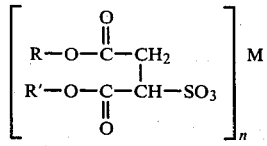

where R and R' are linear or branched alkyl groups having between 4 and 12 carbon atoms, M is an atom of a metal from Group IA or IIA of the Periodic Table of elements, n=1, when M is a metal of Group IA and
n=2, when M is a metal of Group IIA.

2. The method of claim 1, wherein the equipment comprises a desalting unit.

3. The method of claim 1, wherein the equipment comprises a heat exchanger.

4. The method of any one of claim 1 or 3, wherein the compound is added in an amount maximum of 100 ppm by volume of the compound based on the volume of the crude petroleum.

5. The method of claim 4, wherein the compound is sodium di-2-ethylhexylsulfosuccinate.

* * * * *